US010553991B2

(12) United States Patent
Teramoto

(10) Patent No.: US 10,553,991 B2
(45) Date of Patent: Feb. 4, 2020

(54) CONNECTOR

(71) Applicant: Sumitomo Wiring Systems, Ltd., Yokkaichi, Mie (JP)

(72) Inventor: Keisuke Teramoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/274,342

(22) Filed: Feb. 13, 2019

(65) Prior Publication Data

US 2019/0280431 A1 Sep. 12, 2019

(30) Foreign Application Priority Data

Mar. 6, 2018 (JP) ..... 2018-039842

(51) Int. Cl.
*H01R 13/62* (2006.01)
*H01R 13/629* (2006.01)
*H01R 13/52* (2006.01)
*H01R 13/514* (2006.01)

(52) U.S. Cl.
CPC ..... *H01R 13/62977* (2013.01); *H01R 13/514* (2013.01); *H01R 13/5219* (2013.01); *H01R 13/62933* (2013.01)

(58) Field of Classification Search
CPC ..... H01R 13/62933; H01R 13/62938; H01R 13/62944; H01R 13/6295; H01R 13/62955; H01R 13/62961; H01R 13/62994; H01R 13/62977; H01R 13/5219
See application file for complete search history.

(56) References Cited

U.S. PATENT DOCUMENTS 6,764,324 B2 * 7/2004 Shinozaki ..... H01R 13/62933 439/157
8,303,320 B2 * 11/2012 Loncar ..... H01R 13/516 439/157
8,840,409 B2 * 9/2014 Ikeda ..... H01R 13/62938 439/157
9,018,550 B2 * 4/2015 Kobayashi ..... H01H 9/0066 200/50.01
9,028,267 B2 * 5/2015 Furuya ..... H01R 9/16 439/271
9,231,334 B2 * 1/2016 Hara ..... H01R 13/518
9,276,352 B2 * 3/2016 Suzuki ..... H01R 13/56
9,287,662 B2 * 3/2016 Suzuki ..... H01R 13/62922
(Continued)

FOREIGN PATENT DOCUMENTS

JP 2007-336730 12/2007

*Primary Examiner* — Ross N Gushi
(74) *Attorney, Agent, or Firm* — Gerald E. Hespos; Michael J. Porco; Matthew T. Hespos

(57) ABSTRACT

A male connector (10) to be covered together with a board (P) by a case (C) with the male connector (10) connected to the board (P). The male connector (10) includes a male housing (11) connectable to a female connector (60) and including a back wall (25A) partitioning between the outside of the case (C) on the side of the female connector (60) and the inside of the case (C) on the side of the board (P) while extending in a vertical direction. The back wall (25A) has an opening (26) open in a connecting direction of the female connector (60) and allowing communication between the outside and inside of the case (C). A step is provided on an edge of the opening (26) so that an upper edge (26A) of the opening (26) is more forward than a lower edge (26B) of the opening (26).

11 Claims, 7 Drawing Sheets

(56) References Cited

U.S. PATENT DOCUMENTS

| | | | | |
|---|---|---|---|---|
| 9,385,473 | B2 * | 7/2016 | Iwatani | H01R 13/6295 |
| 9,553,393 | B2 * | 1/2017 | Kataoka | H01R 13/502 |
| 9,564,710 | B2 * | 2/2017 | Ebihara | H01R 13/62938 |
| 9,577,378 | B2 * | 2/2017 | Iida | H01R 13/62938 |
| 9,748,693 | B1 * | 8/2017 | Exenberger | H01R 13/6295 |
| 9,768,550 | B2 * | 9/2017 | Goletto | H01R 13/62933 |
| 9,831,577 | B2 * | 11/2017 | Fujii | H01R 13/62933 |
| 9,831,602 | B1 * | 11/2017 | Kanda | H01R 13/62977 |
| 9,865,961 | B2 * | 1/2018 | Shibaya | H01R 13/516 |
| 9,871,322 | B2 * | 1/2018 | Kanda | H01R 13/62955 |
| 9,985,382 | B2 * | 5/2018 | Matsumoto | H01R 13/533 |
| 10,163,590 | B2 * | 12/2018 | Tabata | H01R 13/701 |
| 10,224,672 | B2 * | 3/2019 | Suzuki | H01R 13/62977 |
| 10,381,777 | B2 * | 8/2019 | Hamada | H01R 13/62955 |
| 2009/0305536 | A1 * | 12/2009 | Martin | H01R 13/62955 439/157 |
| 2015/0318639 | A1 * | 11/2015 | Hara | H01R 13/639 439/345 |
| 2016/0141799 | A1 * | 5/2016 | Kataoka | H01R 13/62938 439/372 |
| 2019/0013619 | A1 * | 1/2019 | Obata | H01R 13/62938 |
| 2019/0074633 | A1 * | 3/2019 | Ogashira | H01R 13/62955 |
| 2019/0081438 | A1 * | 3/2019 | Yamane | H01R 13/62938 |
| 2019/0109312 | A1 * | 4/2019 | Shimizu | H01M 2/206 |
| 2019/0131736 | A1 * | 5/2019 | Obata | H01R 13/4368 |

* cited by examiner

CONNECTOR

BACKGROUND

Field of the Invention

This specification relates to a connector.

Related Art

Japanese Unexamined Patent Publication No. 2007-336730 discloses an electrical connection box for preventing intrusion of rainwater into a case body that accommodates an electronic control unit. The case body is composed of first and second case bodies and a connector holder for holding terminals. The first and second case bodies are fit closely without any clearance, and the first and second case bodies are fit closely without any clearance, thereby preventing rainwater and the like drained from a water drainage hole from being drained directly into the case body.

The connector holder may require an opening communicating with the inside of the case body depending on various conditions relating to a mating connector to be connected to the connector holder. However, an opening in the connector holder may permit water running along the connector holder to intrude into the case body through the opening, for example, if water splashes on the connector holder.

A structure for suppressing the entrance of water through an opening is disclosed in this specification.

SUMMARY

This specification is directed to a connector to be connected to a board and to be covered together with the board by a case while the board is connected to the connector. The connector includes a housing connectable to a mating connector, and the housing includes a vertical partition wall that partitions between the male connector side and the board side. The partition wall has an opening that opens in a connecting direction of the male connector and allows communication between the male connector side and the board side. A step is provided on an edge of the opening, and an upper edge part of the opening is disposed more forward than a lower edge part of the opening.

The upper edge part of the opening that allows communication between the mating connector side and the board side is disposed more forward toward the mating connector than the lower edge part of the opening. Thus, water that adheres to the housing and runs along the housing will not intrude to the board side through the opening.

The upper edge part of the opening may be disposed more forward than the lower edge part of the opening by an eaves portion projecting forward from the partition wall.

A method also is provided for arranging a partition wall above an opening that is more forward than a partition wall and for providing a step in which an upper edge of the opening is more forward than a lower edge of the opening. However, to arrange the partition wall above the opening on a front side, the upper partition wall and the lower partition wall are shifted in a front-rear direction, which is the connecting direction. Therefore, a housing is enlarged in the front-rear direction. The upper edge part of the opening can be disposed more forward than the lower edge part of the opening only by providing the eave projecting forward. The intrusion of water to the board side through the opening can be suppressed while enlargement of the housing in the front-rear direction is suppressed.

An upper surface of the eave may be an inclined surface inclined down with distance from the partition wall. According to this configuration, the inclined surface guides water adhering to the eave forward and away from the opening. Thus, the intrusion of water to the board side through the opening can be suppressed further as compared to the case where the upper surface of the eave is not inclined.

The housing may have a cam pin on a side closer to the male connector than the partition wall. The cam pin is configured to engage a lever on the male connector, and the opening may be a mold removal hole for molding the cam pin.

If it is necessary to provide the opening, which is the mold removal hole, in the partition wall to mold the cam pin, this configuration is very effective since the intrusion of water to the board side through the opening can be suppressed.

The partition wall may be a back wall of an accommodating portion for accommodating the lever, and the opening may be provided in the back wall. According to this configuration, the opening in the back wall suppresses the intrusion of water to the board side through the opening, as compared to the case where the opening is provided outside the accommodating portion.

A clearance may be present between the eave and the lever in the processes of connecting and separating the housing and the male connector. According to this configuration, the interference of the eave with the lever can be prevented in the processes of connecting and separating the connector and the mating connector, additionally the connector and the mating connector can be connected and separated smoothly.

An inclined draining portion may be provided below the opening on the partition wall and may be inclined down with distance from the partition wall. According to this configuration, water dropped from the upper edge part of the opening can be drained forward away from the board along the inclined draining portion.

According to the technique disclosed by this specification, it is possible to suppress the entrance of water through an opening.

DETAILED DESCRIPTION

An embodiment of the invention is described with reference to FIGS. 1 to 7.

Figure 4:
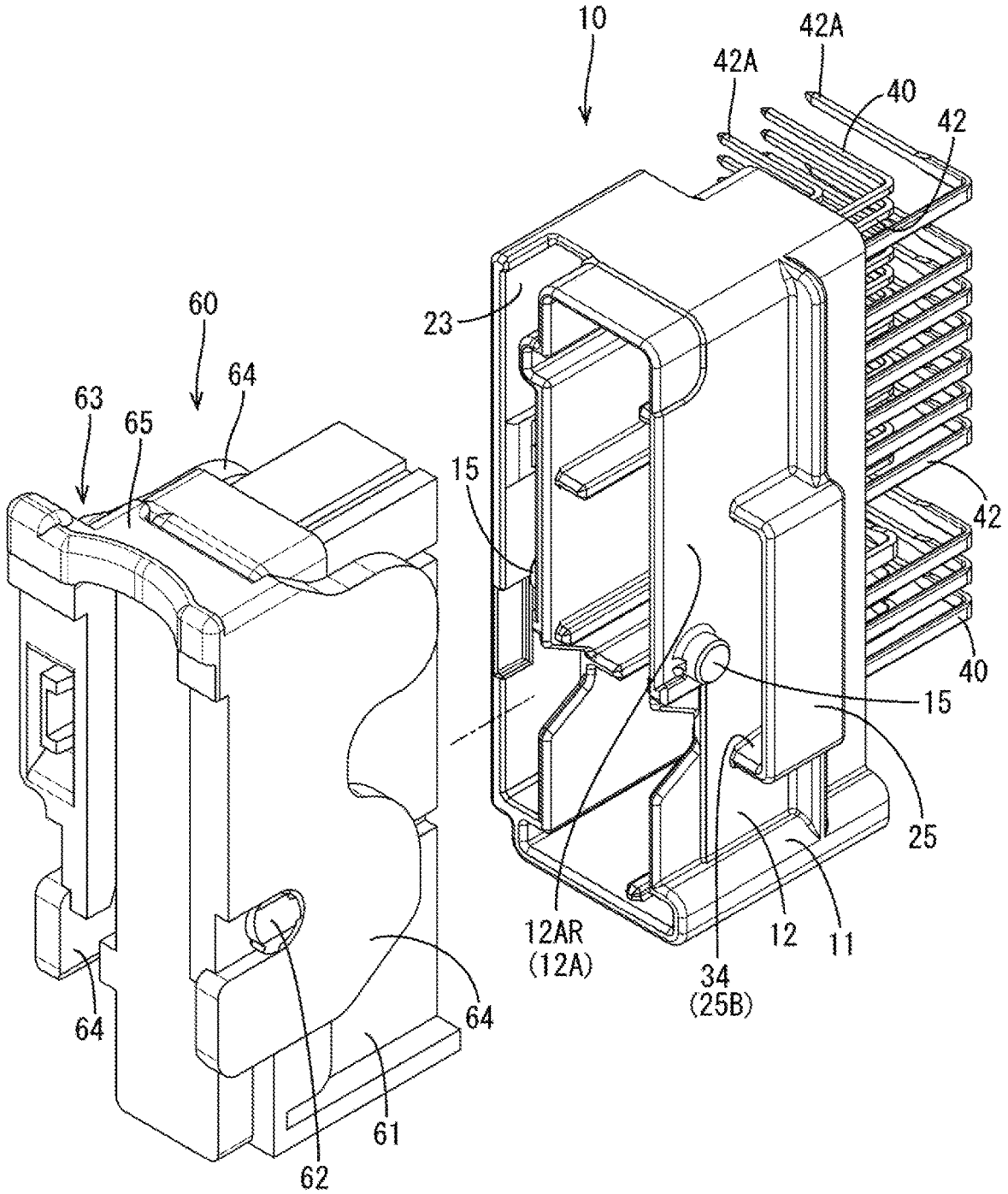
FIG. 4 is a perspective view showing a state before the male connector and a female connector are connected.
Figure 6:
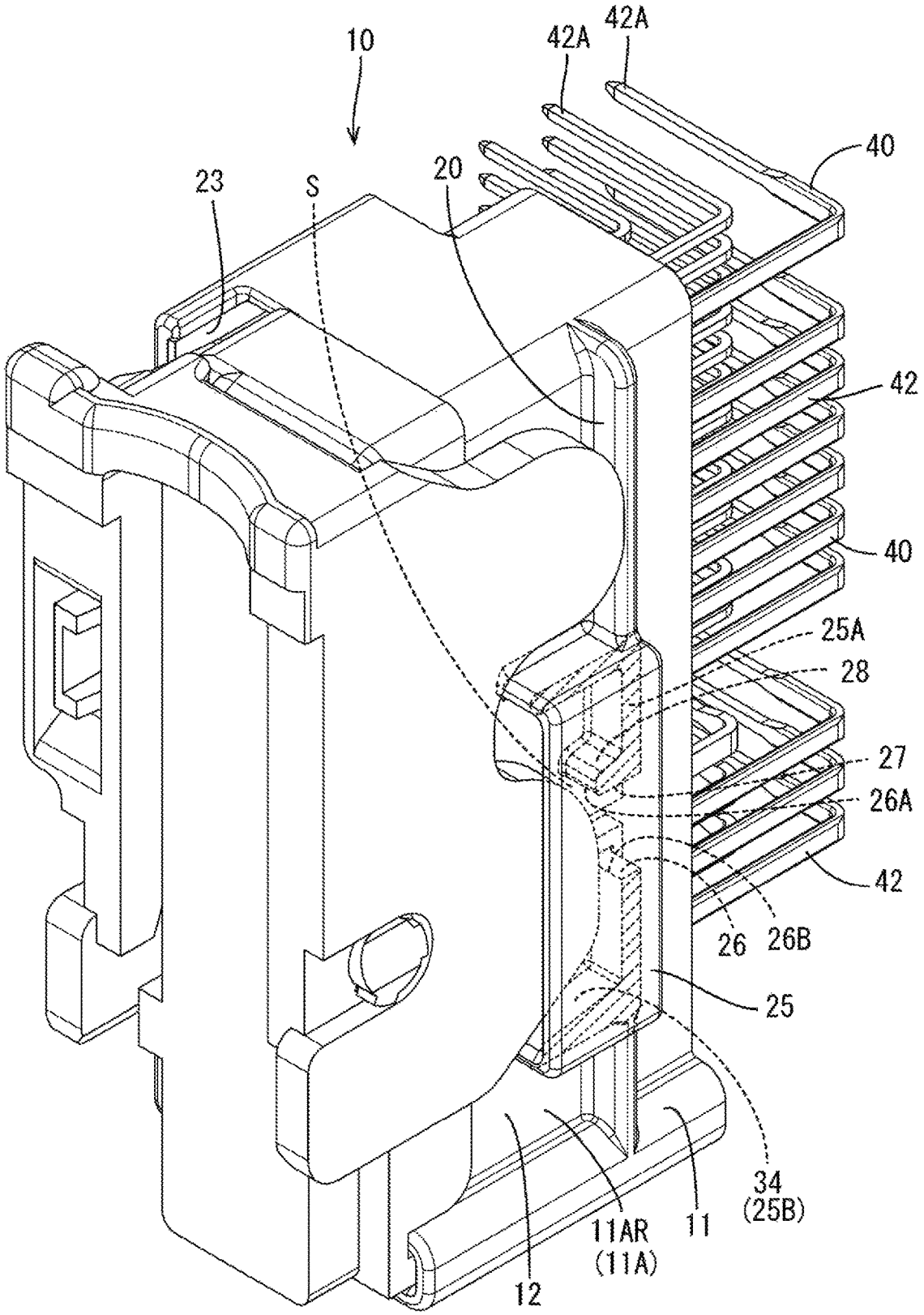
FIG. 6 is a perspective view showing a state where the male connector and the female connector are connected.

This embodiment relates to a male connector 10 to be installed in an unillustrated vehicle interior while being connected to a board P and connectable to a mating female connector 60, as shown in FIGS. 4 and 6.

In the following description, directions to bring the male connector 10 and the female connector 60 toward each other are referred to as forward directions and opposite directions are referred to as rearward directions. Further, a vertical direction is based on a vertical direction in FIGS. 1 and 2.

The female connector 60 is made of synthetic resin and includes, as shown in FIG. 4, a female housing 61 in the form of a substantially rectangular block, and unillustrated female terminals are held in the female housing 61. A lever 63 is assembled with the female housing 61 and is rotatable about rotary shafts 62 provided on side surfaces of the female housing 61.

The lever 63 includes two cam plates 64 each of which has an unillustrated cam groove, and a rotating portion 65 coupling ends of the cam plates 64. The lever 63 is rotatable between an initial position and a connection position shown in FIG. 6 by rotating the rotating portion 65. The lever 63 assists the connection and separation of the male connector 10 and the female connector 60 by being rotationally displaced between the initial position and the connection position.

As shown in FIGS. 1 to 4, the male connector 10 includes a male housing 11 made of synthetic resin and male terminals 40.

The male housing 11 has a substantially rectangular parallelepiped shape long in the vertical direction and includes a forwardly open receptacle 12. The female housing 61 is fit into the receptacle 12 when the male connector 10 and the female connector 60 are connected. Further, a case C for covering the male housing 11 and the board P is assembled with the male housing 11 from the right, as shown in FIG. 1.

As shown in FIG. 4, the male terminal 40 is formed from a wire material that is excellent in conductivity and is bent into an L shape. As shown in FIG. 1, the male terminal 40 is held in a holding wall 12A disposed in a back part of the receptacle 12 with a front part 41 projecting forward. Thus, when the female housing 61 is fit into the receptacle 12, the front part 41 of each male terminal 40 is connected electrically to each female terminal of the female connector 60.

Figure 1:
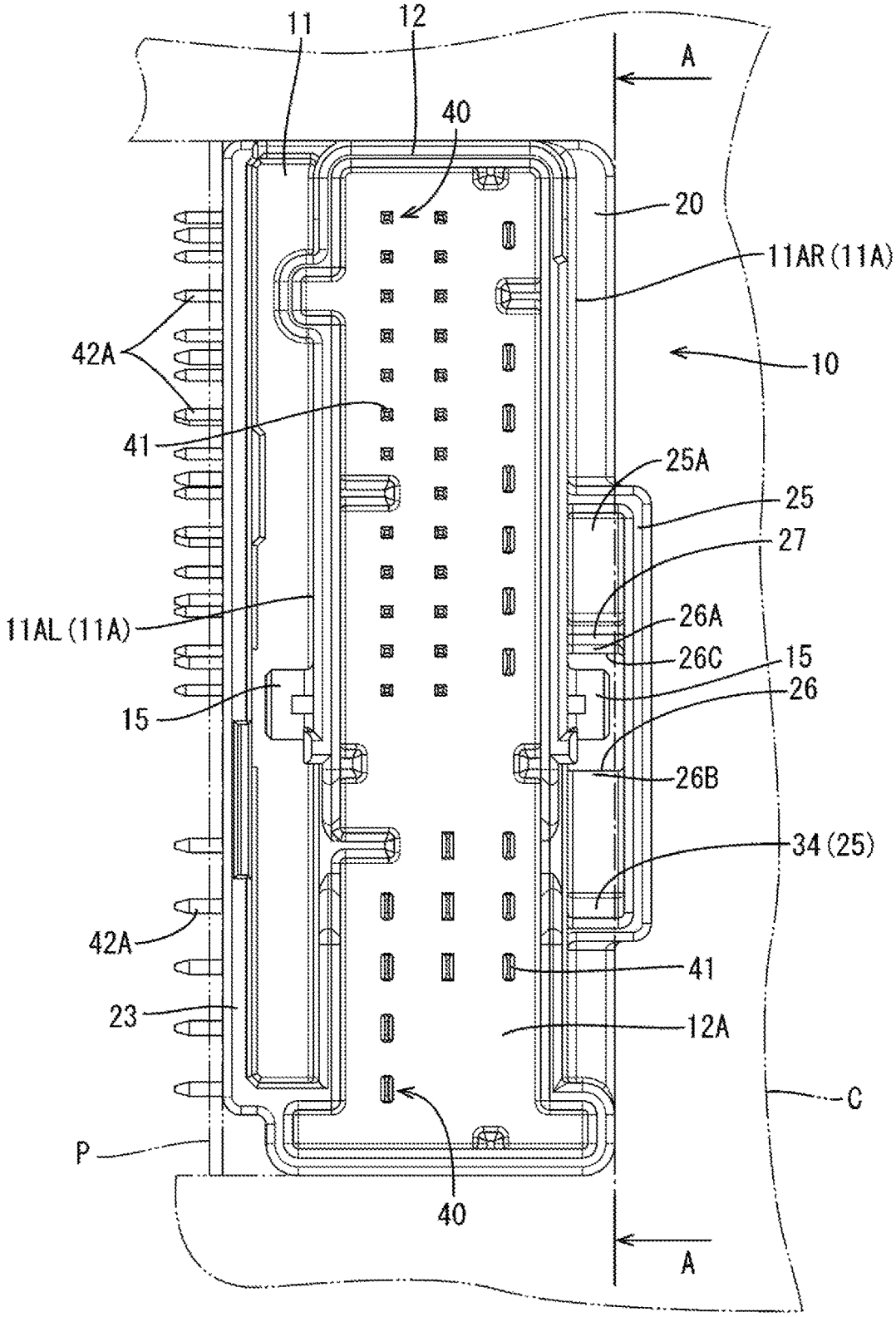
FIG. 1 is a front view of a male connector.

As shown in FIG. 1, a rear part 42 of each male terminal 40 is bent at a right angle to extend left after extending rearward from the holding wall 12A. More particularly, a left part 42A is bent at a right angle to extend left in the rear end part 42 of the male terminal 40 is inserted into an unillustrated through hole in the board P and is connected to the board P by soldering or the like.

As shown in FIGS. 1 to 4, two cam pins 15 are provided substantially in central parts of both left and right surfaces 11A of the male housing 11 in the vertical direction and are configured to engage the cam grooves in the lever 63 of the female housing 61. The cam pins 15 are disposed at positions before substantially central parts of the both left and right surfaces 11A of the male housing 11 in a front-rear direction. Each cam pin 15 is a cylinder projecting out from the male housing 11. The cam pins 15 and the peripheral edges of the cam grooves of the lever 63 are engaged by rotating the lever 63 so that the male connector 10 and the female connector 60 are connected by a boosting action.

A vertically extending partition wall 20 is provided substantially over the entire height of the male housing 11 on the right side surface 11AR of the male housing 11. The partition wall 20 is arranged at a position behind the cam pin 15 and somewhat behind a substantially central part of the right surface 11AR of the male housing 11 in the front-rear direction. The partition wall 20 partitions between the inside of the case C in which the board P is arranged and the outside of the case C (on the side of the female connector 60) when the female housing 61 and the board P are covered from the right by the case C.

A forwardly open accommodating portion 25 is provided behind the cam pin 15 on the right side surface 11AR of the male housing 11 and accommodates a part of one cam plate 64 of the lever 63 in the process of connecting the male connector 10 and the female connector 60. The accommodating portion 25 is substantially rectangular in a side view, and is formed integrally and continuously with the partition wall.

A large accommodating portion 23 is provided on the left side surface 11AL of the male housing 11 and accommodates a part of the other cam plate 64 of the lever 63 in the process of connecting the male and female connectors 10 and 60. The large accommodating portion 23 is a forwardly open receptacle similar to the accommodating portion 25.

The accommodating portion 25 and the large accommodating portion 23 accommodate the parts of the cam plates 64 of the lever 63 to prevent the cam plates 64 from being inclined and opened in directions separating from the female housing 61 when the peripheral edges of the cam grooves in the cam plates 64 and the cam pins 15 engage.

A rear end part of the accommodating portion 25 is connected to the partition wall 20 and a part of the partition wall 20 constitutes a back wall 25A of the accommodating portion 25. An opening 26 penetrates the back wall 25A (partition wall 20) of the accommodating portion 25 in the front-rear direction at a position behind the cam pin 15. The opening 26 is a mold removal hole for molding a rear part of the cam pin 15 by unillustrated molds that are opened in the front-rear direction, and formed to penetrate through the back wall 25A. Thus, the inside and outside of the case C communicate through the opening 26 in the back wall 25A of the accommodating portion 25.

Figure 2:
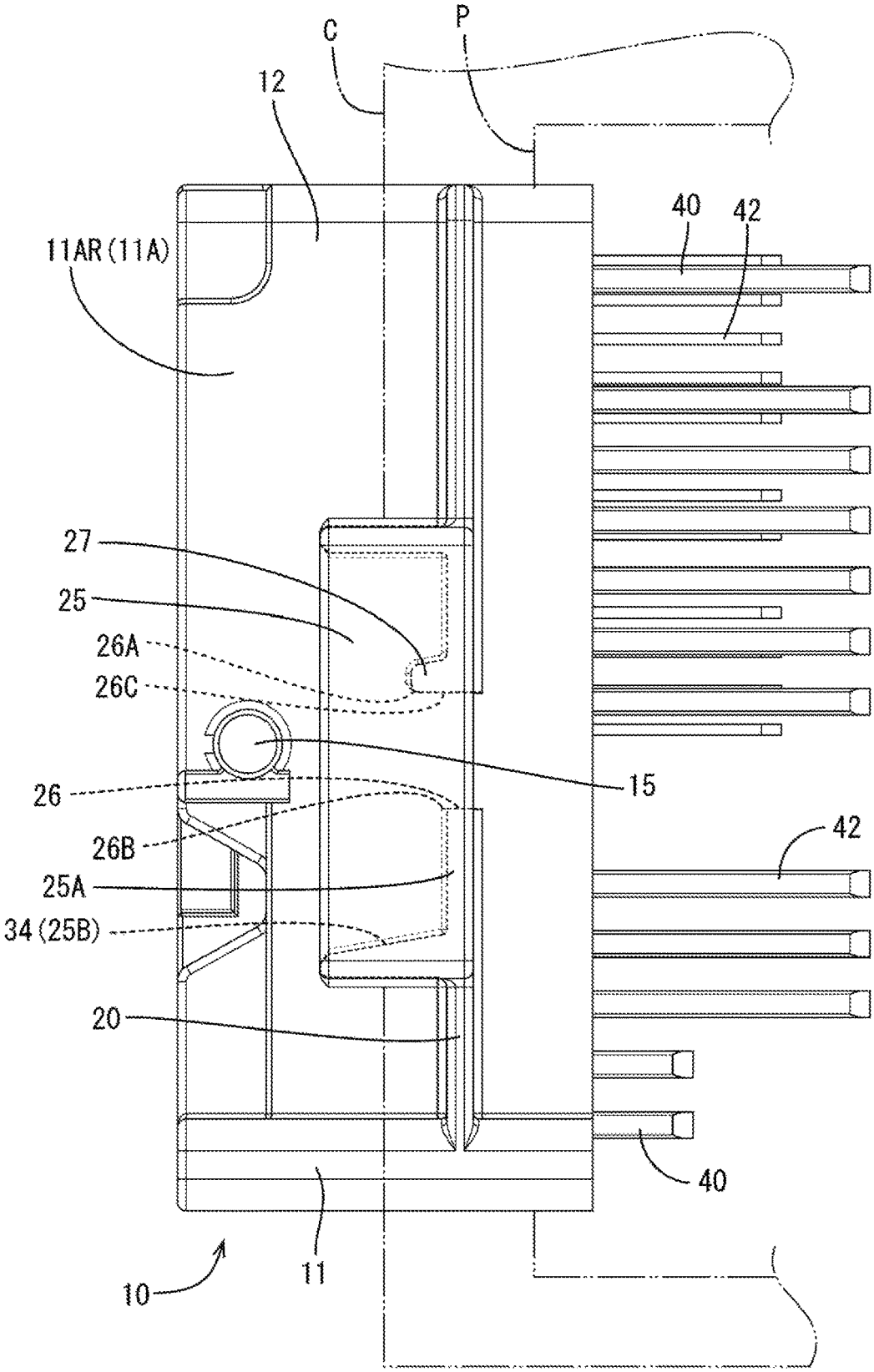
FIG. 2 is a side view of the male connector.
Figure 3:
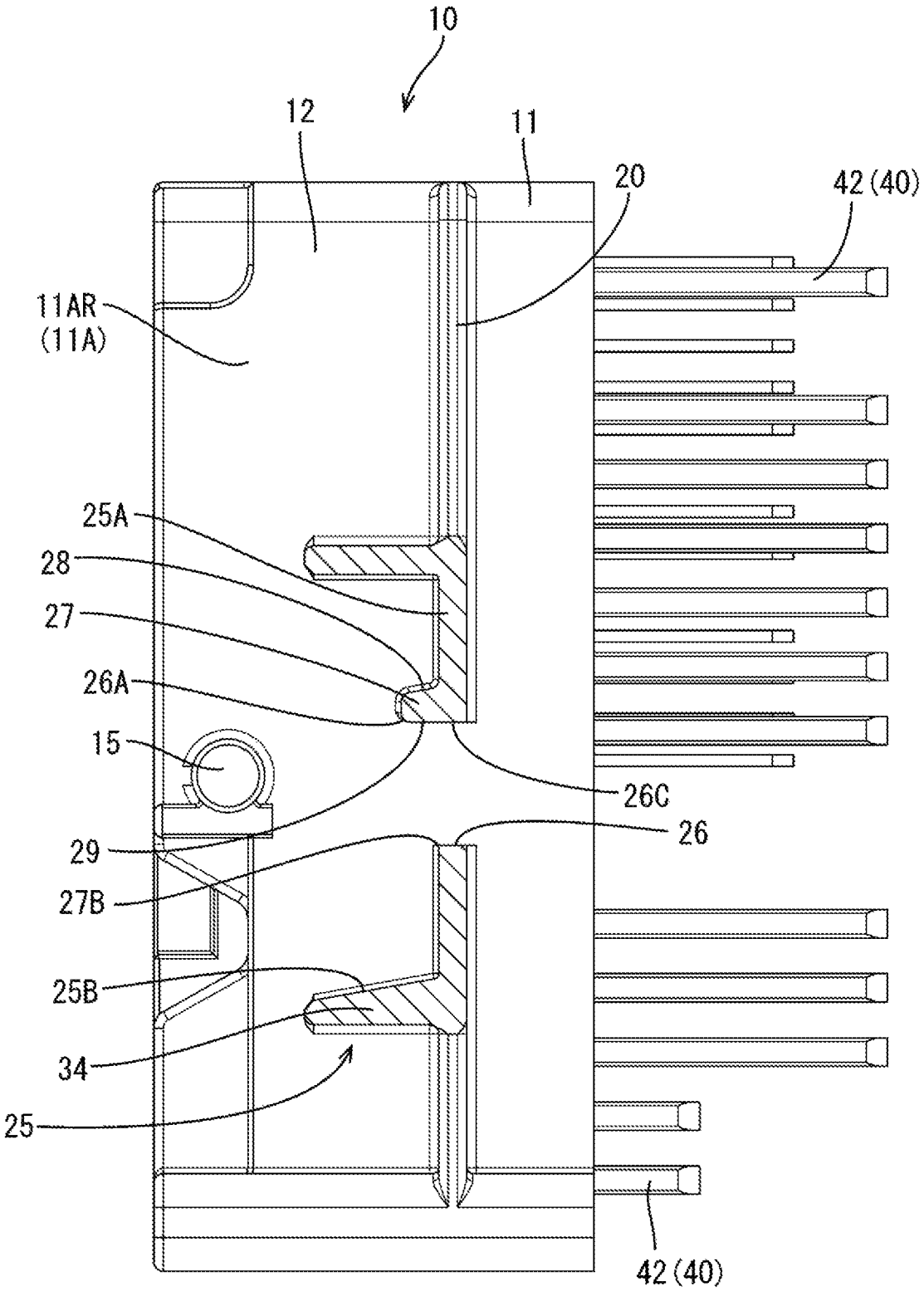
FIG. 3 is a section along A-A of FIG. 1.
Figure 5:
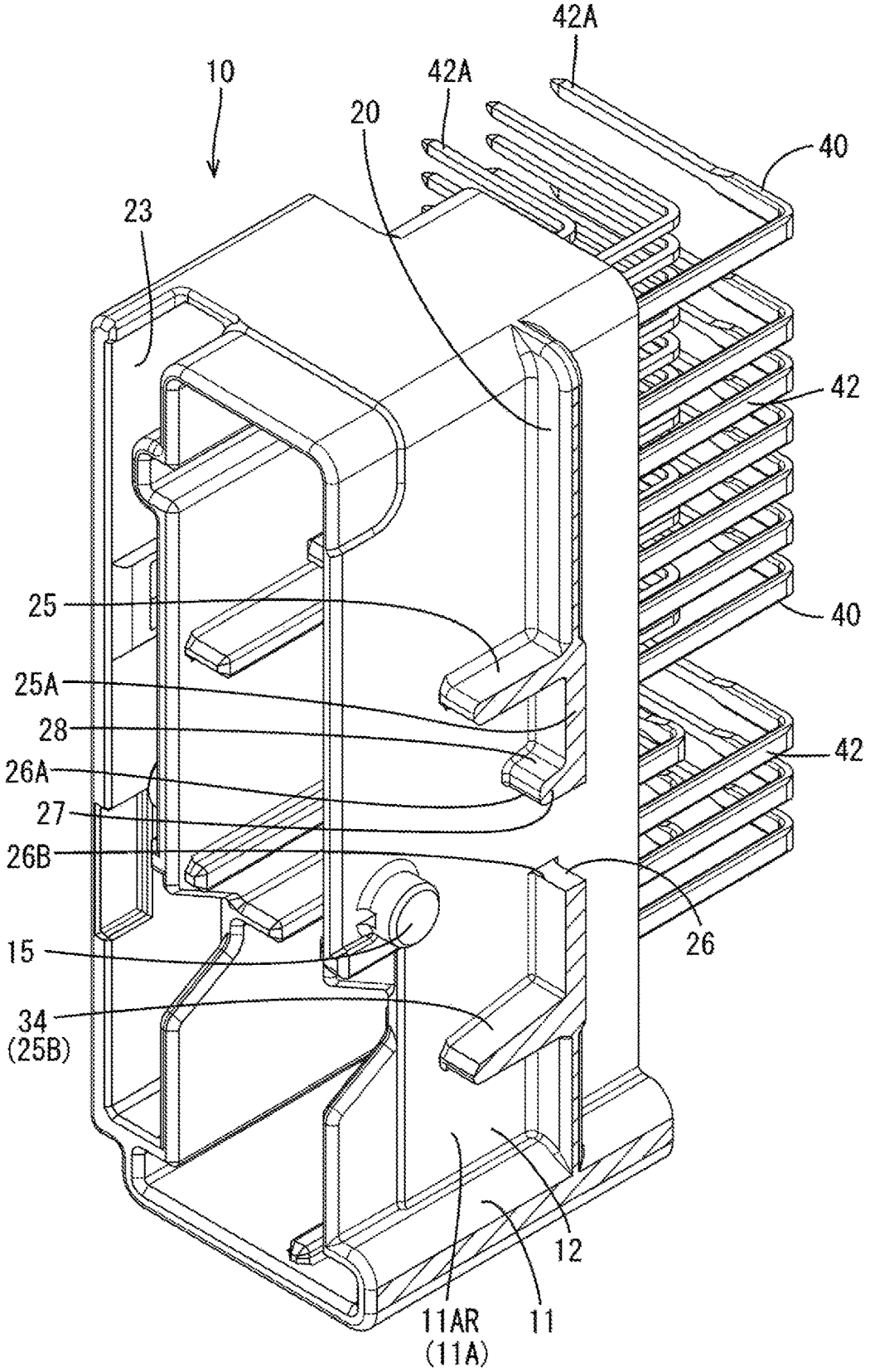
FIG. 5 is a cross-sectional perspective view taken along line A-A of FIG. 1.

The opening 26 in the back wall 25A of the accommodating portion 25 has a step formed by disposing an upper edge 26A of the opening 26 more forward than a lower edge part 26B of the opening 26, as shown in FIGS. 2, 3 and 5. In particular, an eave 27 projects forward from the upper edge 26A of the opening 26 in the back wall 25A of the accommodating portion 25 and extends over the entire width of the opening 26.

As shown in FIG. 6, a projecting dimension of the eave 27 is set to define a clearance S between the eave 27 and the lever 63 of the female connector 60 when the male and female connectors 10 and 60 reach a properly connected state. Thus, connecting and separating operations can be performed smoothly without the eave 27 interfering with the lever 63.

The upper surface of the eave 27 forms an inclined surface 28 that inclines down toward the front, and a lower surface 29 of the eave 27 is flush with an upper surface 26C of the opening 26 through the back wall 25A.

Figure 7:
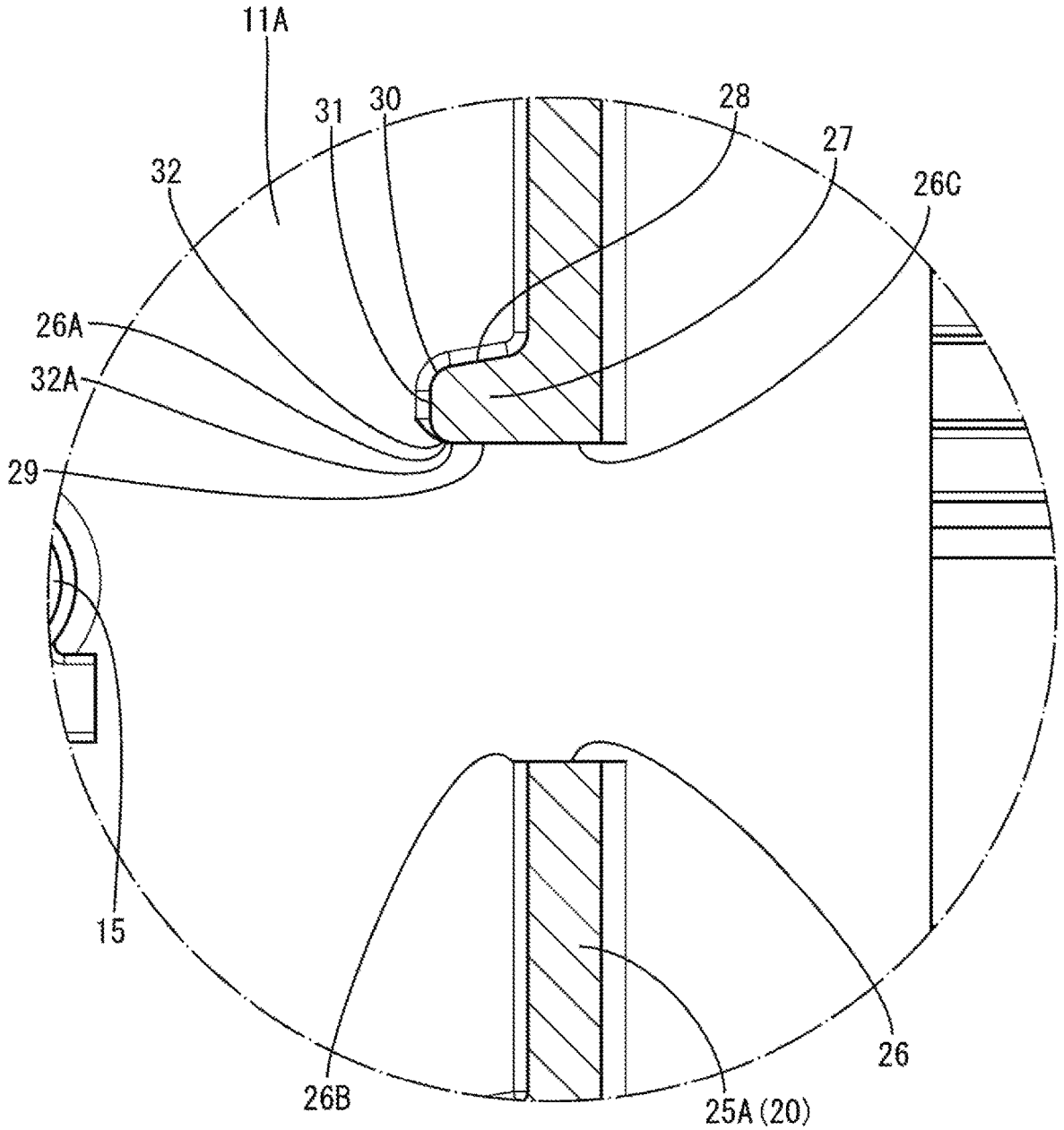
FIG. 7 is an enlarged section of an essential part of FIG. 3.

As shown in FIG. 7, a projecting end of the eave 27 is formed by: an upper R surface 30 that is arcuate from the front end of the inclined surface 28 toward a lower side; a leading end surface 31 that extends straight down from a lower end of the upper R surface 30; and a lower R surface 32 that is arcuate from a lower end part of the leading end surface 31 to the lower surface 29 of the eave 27. A rear end 32A of the lower R surface 32 is disposed before the lower edge 26B of the opening 26. Accordingly, the upper edge 26A of the opening 26 is more forward than the lower edge 26B of the opening 26 by the forward projecting dimension of the eave 27.

An inner bottom surface 25B of the accommodating portion 25 is provided with an inclined drain 34. As shown in FIGS. 2 and 3, the inclined drain 34 slopes down toward the front and is provided over the entire length in the front-rear direction from the back wall 25A of the accommodating portion 25 to a front end of the accommodating portion 25.

This embodiment is configured as described above. Next, functions and effects of the male connector 10 are described.

The male connector 10 is covered from right by the case C, but liquid, such as water, intrudes into a clearance between the male housing 11 and the female housing 61 if the liquid splashes.

Thus, if the opening 26 is provided in the partition wall 20 partitioning between the inside and outside of the case C, liquid may intrude from the outside of the case C located before the partition wall 20 (on the side of the female connector 60) into the inside of the case C located behind the partition wall 20 (on the side of the board P) through the opening 26.

However, the male connector 10 of this embodiment has the opening 26 in the back wall 25A of the accommodating portion 25 that accommodates the lever 63 of the female connector 60. Thus, liquid is less likely to intrude through the opening 26 and into the inside of the case (board side).

Further, the opening 26 has the eave 27 projecting forward from the partition wall 20 on the upper edge 26A, and the upper surface of the eave 27 is formed into the inclined surface 28 inclined down with distance from the partition wall 20.

That is, since the opening 26 is provided with the step in which the upper edge 26A of the opening 26 is more forward than the lower edge 26B of the opening 26, and the eave 27 is provided with the inclined surface 28, even if liquid intrudes into the accommodating portion 25 and runs to the upper edge 26A of the opening 26, the liquid is guided in a direction separating from the board P by the inclined surface 28 of the eave 27. In this way, the intrusion of liquid into the case C through the opening 26 can be suppressed.

Liquid that intrudes into the accommodating portion 25 is guided in the direction separating from the board P along the inclined surface 28 of the eave 27, but some of the liquid may intrude into the case C through the opening 26 along the eave 27. However, according to this embodiment, the projecting end of the eave 27 is formed by the upper R surface 30, the leading end surface 31 and the lower R surface 32, as shown in FIG. 7, and a height position between the lower R surface 32 and the lower surface 29 of the eave 27 is a lowermost position on the upper edge 26A of the opening 26.

That is, the liquid running from the inclined surface 28 reaches the leading end surface 31 along the upper R surface 30 and the liquid having reached the leading end surface 31 runs along the lower R surface 32 and drops in a part between the lower R surface 32 and the lower surface 29 of the eave 27.

Liquid dropped from the eave 27 is drained obliquely from the accommodating portion 25 to a front-lower side along the upper surface of the inclined draining portion 34.

As described above, according to the male connector 10 of this embodiment, the opening 26 is provided with the eave 27 projecting forward from the back wall 25A of the accommodating portion 25, thereby providing the step in which the upper edge 26A of the opening 26 is more forward than the lower edge 26B of the opening 26. Specifically, the upper edge 26A of the opening 26 is more distant from the board P than the lower edge 26B of the opening 26. Thus, any liquid that intrudes into the clearance between the male housing 11 and the female housing 61 is not likely to intrude to the side of the board P inside the case C through the opening 26.

For example, an opening including a step in which an upper edge of the opening is more forward than a lower edge of the opening is provided by arranging a back wall above the opening more forward than a back wall below the opening. However, in the case of arranging the back wall above the opening on a front side, a male housing is enlarged in the front-rear direction since the upper back wall and the lower back wall are shifted in the front-rear direction.

However, in this embodiment, the eave 27 projects forward from the back wall 25A of the accommodating portion 25 to position the upper edge 26A of the opening 26 more forward than the lower edge 26B of the opening 26. Therefore, the intrusion of liquid into the case C through the opening 26 is prevented without enlarging the male housing 11 in a connecting direction.

Further, the upper surface of the eave 27 is formed into the inclined surface 28 inclined down with distance from the back wall 25A and liquid splashed on the eave 27 is guided in the direction separating from the opening 26 along the inclined surface 28 for further preventing intrusion of liquid into the case C through the opening 26.

The back wall 25A of the accommodating portion 25 must have the opening 26 as a mold removal hole to mold the cam pin 15 in this embodiment. Thus, this embodiment can suppress the intrusion of liquid into the case C through the opening 26 and is very effective.

The inclined drain 34 is below the opening 26 on the back wall 25A of the accommodating portion 25 and inclines down with distance from the back wall 25A. Thus, liquid dropped from the eave 27 drains to the outside of the accommodating portion 25 along the inclined drain 34 to suppress intrusion of liquid into the case C through the opening 26.

The invention is not limited to the above described embodiment. For example, the following various modes also are included.

The opening 26 is provided in the back wall 25A of the accommodating portion 25. However, an opening may be formed in any part of a partition wall.

The opening 26 is formed as a mold removal hole for the cam pin 15. However, an opening may be formed as a mold removal hole for another member.

The upper edge 26A of the opening 26 is more forward than the lower edge 26B of the opening 26 by having the eave 27 projecting forward from the back wall 25A of the accommodating portion 25. However, a back wall above an opening may be disposed more forward than a back wall below the opening.

The male housing 11 is covered together with the board P from right by the case C. However, a male connector may be covered together with a board from left, above or below.

The connector may be a female connector.

LIST OF REFERENCE SIGNS

10: male connector (example of connector)
11: male housing (example of housing)
15: cam pin
20: partition wall
25: accommodating portion
25A: back wall
26: opening
26A: upper edge of opening
26B: lower edge of opening
27: eave
28: inclined surface
34: inclined drain

60: female connector (example of mating connector)
63: lever
C: case
P: board
S: clearance

What is claimed is:

1. A connector to be covered together with a board by a case with the board connected to the connector, comprising:

a housing connectable to a mating connector and including a partition wall partitioning between the mating connector and the board while extending in a vertical direction; wherein:

the partition wall is provided with an opening open in a connecting direction of the mating connector and allowing communication between the mating connector and the board; and a step is provided on an edge part of the opening in which an upper edge of the opening is disposed more forward than a lower edge of the opening.

2. The connector of claim 1, wherein the upper edge of the opening is disposed more forward than the lower edge of the opening by an eave projecting forward from the partition wall.

3. The connector of claim 2, wherein an upper surface of the eave is an inclined surface inclined down with distance from the partition wall.

4. The connector of claim 3, wherein:

the housing is provided with a cam pin on a side closer to the mating connector than the partition wall, the cam pin being configured to engage a lever provided on the mating connector; and the opening is a mold removal hole for molding the cam pin.

5. The connector of claim 4, wherein the partition wall is a back wall of an accommodating portion for accommodating the lever and the opening is provided in the back wall.

6. The connector of claim 5, wherein a clearance is present between the eave and the lever in the processes of connecting and separating the housing and the mating connector.

7. The connector of claim 3, wherein an inclined drain is provided below the opening in the partition wall and is inclined down with distance from the partition wall.

8. The connector of claim 1, wherein:

the housing is provided with a cam pin on a side closer to the mating connector than the partition wall, the cam pin being configured to engage a lever provided on the mating connector; and the opening is a mold removal hole for molding the cam pin.

9. The connector of claim 8, wherein the partition wall is a back wall of an accommodating portion for accommodating the lever and the opening is provided in the back wall.

10. The connector of claim 9, wherein a clearance is present between the eave and the lever in the processes of connecting and separating the housing and the mating connector.

11. The connector of claim 1, wherein an inclined drain is provided below the opening in the partition wall and is inclined down with distance from the partition wall.

* * * * *